US006309258B1

(12) United States Patent
Measley

(10) Patent No.: US 6,309,258 B1
(45) Date of Patent: Oct. 30, 2001

(54) SINGLE POLE CABLE CONNECTOR

(75) Inventor: Steven Jeffrey Measley, La Grange, NC (US)

(73) Assignee: Cooper Industries, Inc., Houston, TX (US)

( * ) Notice: Subject to any disclaimer, the term of this patent is extended or adjusted under 35 U.S.C. 154(b) by 0 days.

(21) Appl. No.: 09/177,533

(22) Filed: Oct. 23, 1998

(51) Int. Cl.[7] ..... H01R 13/42; H01R 4/36; H01R 11/03; H01R 27/00

(52) U.S. Cl. ..... 439/738; 439/814; 439/224; 439/792

(58) Field of Search ..... 439/98, 810, 811, 439/812, 813, 814, 224, 217, 789, 790, 791, 792, 737, 738, 739, 752

(56) References Cited

U.S. PATENT DOCUMENTS

| | | | | |
|---|---|---|---|---|
| 3,784,964 | * | 1/1974 | Newman et al. | 439/603 |
| 4,214,806 | * | 7/1980 | Kraft | 339/242 |
| 4,428,641 | | 1/1984 | Flachbarth et al. | 339/205 |
| 4,565,417 | | 1/1986 | Düssel et al. | 339/94 |
| 4,917,632 | | 4/1990 | Smith | 439/624 |
| 5,137,476 | * | 8/1992 | Noble | 439/797 |
| 5,201,914 | * | 4/1993 | Hollick | 439/801 |
| 5,244,415 | | 9/1993 | Marsilio et al. | 439/610 |
| 5,536,183 | | 7/1996 | Brandolf | 439/470 |
| 5,722,841 | | 3/1998 | Wright | 439/98 |

FOREIGN PATENT DOCUMENTS 0 818 849 A2 1/1998 (EP) .

OTHER PUBLICATIONS

Circle 58 on Reader Service Card; ECT. Advertisement; 09/97; p.88.
ECT Single Pole Cam–Type Cable Connectors Catalog.

* cited by examiner

*Primary Examiner*—Paula Bradley
*Assistant Examiner*—Edwin A. León
(74) *Attorney, Agent, or Firm*—Fish & Richardson P.C.

(57) ABSTRACT

A single-pole electrical connector includes an insulating sleeve and a retention ring positioned in the insulating sleeve. The retention ring defines an inner channel and a groove in a surface of the inner channel. The retention ring also includes a threaded hole intersecting the groove. A screw positioned in the threaded hole blocks the groove when in an extended position and leaves the groove unblocked when in a retracted position. A contact positioned in the inner channel includes a drive pin positioned in the groove. The contact is secured within the insulating sleeve when the screw is in the extended position and movable relative to the insulating sleeve when the screw is in the retracted position.

18 Claims, 8 Drawing Sheets

SINGLE POLE CABLE CONNECTOR

TECHNICAL FIELD

The invention relates to single pole cable connectors.

BACKGROUND

Single-pole connectors are used to connect a single wire or cable. One type of known connector uses a retention screw to secure a contact of the connector in an insulating sleeve of the connector. The contact includes a threaded hole that receives the retention screw, which also passes through the insulating sleeve. The contact attaches to an electrical cable on one end and the contact is configured to connect to another contact on the other end.

Another type of connector uses a contact having a locking drive pin. After a cable is connected to the contact, the contact is inserted into an insulated sleeve until the locking drive pin engages a locking structure in the sleeve.

SUMMARY

In one general aspect, a single-pole electrical connector includes an insulating sleeve defining an inner channel and a groove defined in a surface of the inner channel. A blocking mechanism is operable to be positioned to block the groove.

Embodiments may include one or more of the following features. For example, the connector may include a retention ring positioned in the insulating sleeve and defining at least a portion of the inner channel. The groove may be defined in an inner surface of the retention ring. The retention ring may carry the blocking mechanism, which may be, for example, a screw. To this end the retention ring may include a threaded hole that perpendicularly intersects the groove. The blocking mechanism also may be, for example, a snap in retaining pin, a rotating member, or a component glued or snapped into place in the groove.

The connector also includes an electrical contact sized to fit within the inner channel. A drive pin extending from an outer surface of the contact is sized to fit within the groove. Generally, the channel and contact have circular cross sections.

The screw may be a nonconductive screw having a nonconductive head and a nonconductive threaded portion. This offers advantages over screws having nonconductive heads and conductive threaded portions in that the screws are inexpensive to manufacture and pose no risk of exposed conductive material in the event that the head of the screw is broken.

In general, the screw is accessible from outside the insulating sleeve through a hole in the insulating sleeve. A cross section of at least a portion of the hole is smaller than a maximum cross section of the screw to prevent separation of the screw from the electrical connector. This ensures that the screw will not be lost and thereby eliminates a major source of inconvenience and user frustration.

The invention provides a single pole electrical connector that provides safe operation, that is inexpensive to manufacture, and that is easy to reuse. In particular, assembly and disassembly of the connector requires only a screwdriver.

The drive pin-and-groove connection arrangement provides considerable advantages over approaches that use a screw threaded into the contact to secure the contact in the insulating sleeve. In particular, the contact only needs to be positioned in the channel of the insulating sleeve with the drive pin aligned with the groove. The contact is then pushed completely into the insulating sleeve and secured in place by tightening the screw to block the groove. By contrast, to thread the screw into the contact, the contact needs to be carefully aligned, both radially and axially, with the screw in order to insert the screw into the hole in the contact.

Other features and advantages will be apparent from the following description, including the drawings, and from the claims.

DESCRIPTION OF DRAWINGS

FIGS. 4G and 4H are sectional views taken along line 4G—4G of FIG. 4C. FIGS. 4I and 4J are sectional views taken along line 4E—4E of FIG. 4D.

DETAILED DESCRIPTION

Figure 1A:
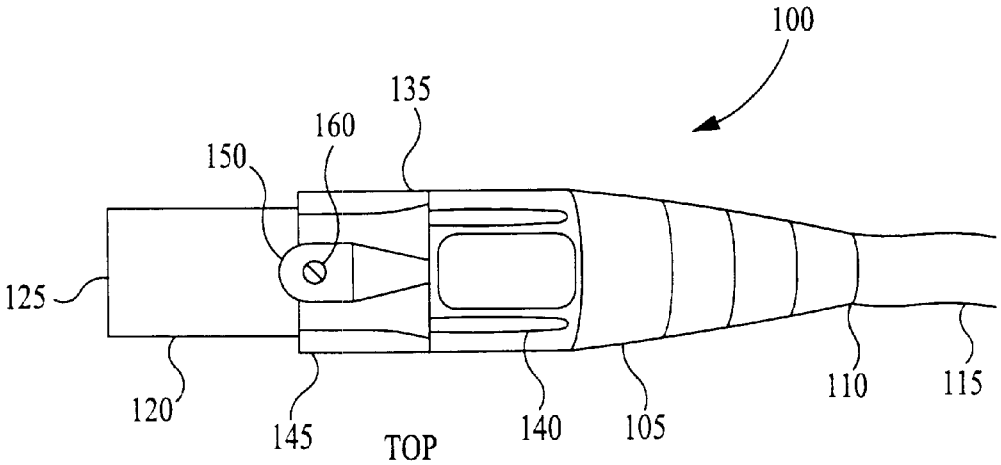
FIGS. 1A–1C are top, side and end views of a cable connector.
Figure 1B:
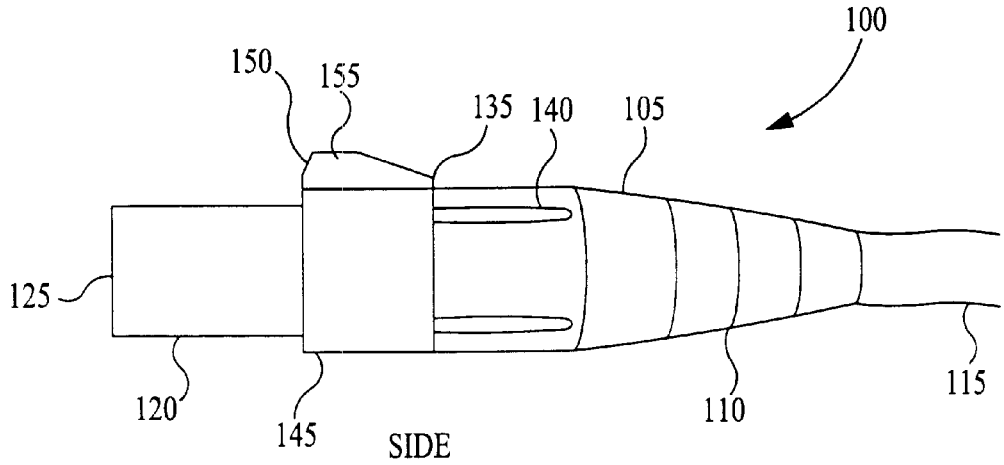
Figure 1C:
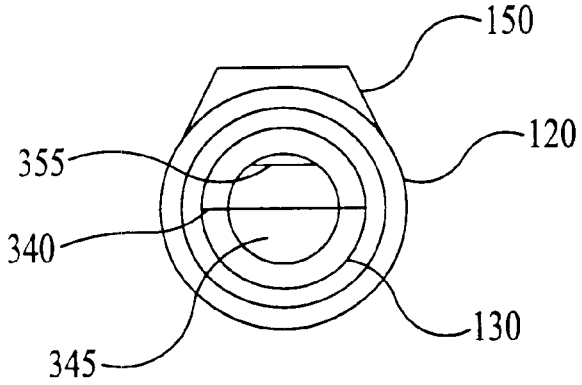

Referring to FIGS. 1A–1C, a single pole cam-type cable connector 100 includes an insulating sleeve 105. The sleeve 105 is generally cylindrical and includes a tapered end 110 from which an insulated cable 115 extends. The tapered end 110 is positioned opposite a cylindrical connection portion 120. The portion 120 has an open end 125 that permits access to a conductive contact 130 and interacts with a connection portion of, for example, a mating connector or a supply panel to isolate the contact 130 from the external environment.

The insulating sleeve 105 includes a central portion 135 between the tapered end 110 and the connection portion 120. The central portion 135 is grasped to manipulate the connector 100. For this purpose, the central portion 135 includes raised ridges 140 that provide gripping surfaces. The central portion 135 also includes an expanded ring portion 145 having a protrusion 150. The protrusion 150 includes an opening 155 through which a nonconductive screw 160 may be accessed. The opening 155 is sized to prevent removal of the screw 160. As discussed in detail below, the screw 160 secures the contact 130 in place within the sleeve 105 and allows for removal of the contact 130 and reuse of the connector 100.

The insulating sleeve 105 is made from an insulating material such as rubber. The sleeve 105 is generally rigid, but has slight flexibility at the ends 110, 125.

Figure 2B:
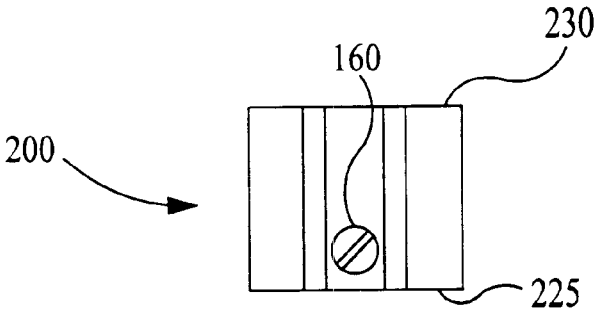
FIGS. 2A–2C are front, top and side views of a retaining ring of the connector of FIG. 1A.
Figure 2A:
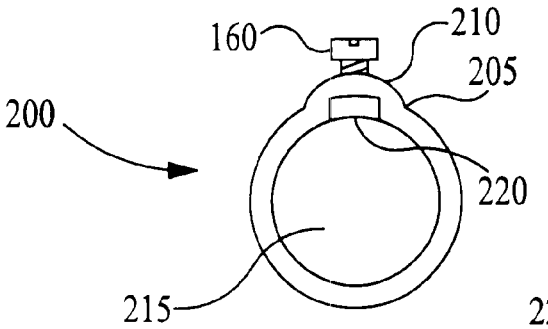
Figure 2C:
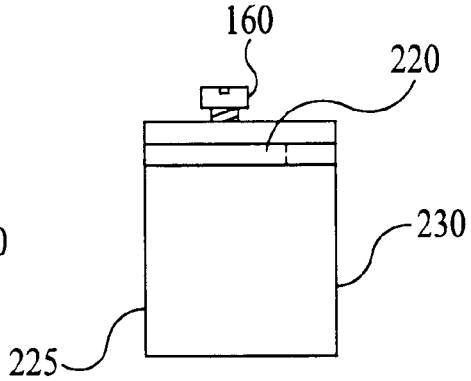

Referring to FIGS. 2A–2C, the insulating sleeve 105 contains a retention ring 200 formed from a rigid material, such as plastic. The retention ring 200, which is generally cylindrical, is positioned in the sleeve 105 in a region defined by the expanded ring portion 145, and includes a protrusion 205 corresponding to the protrusion 150. The protrusion 205 includes a threaded opening 210 that receives the screw 160. The retention ring 200 retains the contact 130 within the sleeve 105.

The retention ring 200 defines a central channel 215 sized to receive the contact 130. A groove 220 is formed in a surface of the channel underlying the protrusion 205. The groove extends from a first end 225 of the channel. The groove 220 terminates before reaching the second end 230 of the channel 215. The groove 220 is intersected by the threaded opening 210.

Figure 3B:
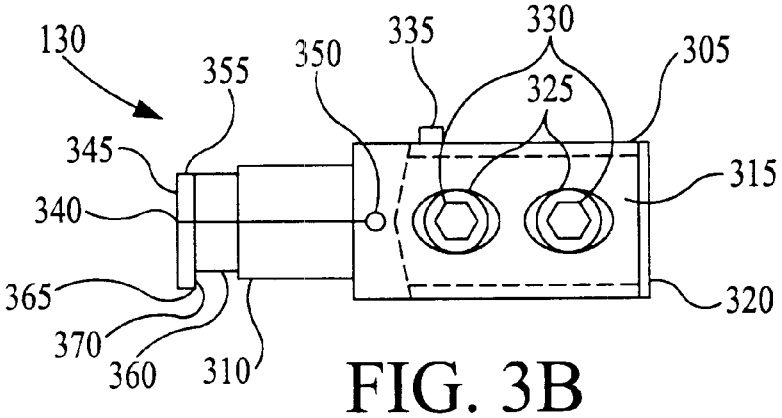
FIGS. 3A–3C are top, front and end views of a contact of the connector of FIG. 1A.
Figure 3A:
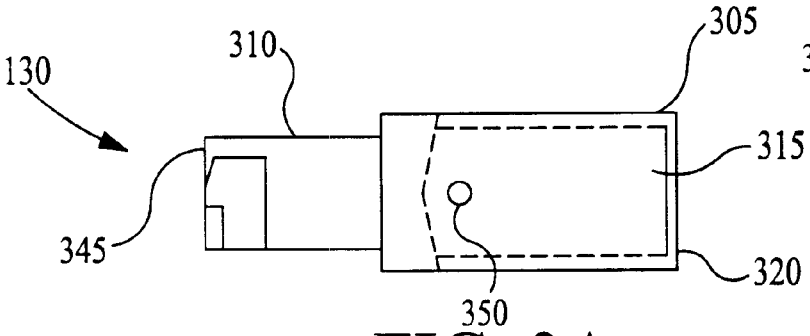
Figure 3C:
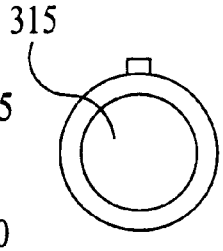

Referring to FIGS. 3A–3C, the contact 130 includes a generally cylindrical body portion 305 from which extends a generally cylindrical connection portion 310. The body portion 305 defines a channel 315 along most of its length. The channel 315 extends from an end 320 opposite the connection portion 310 to just short of the connection portion 310. In use, an electrical cable is positioned in the channel 315. Two recessed holes 325 in the outer wall of channel are threaded to receive two set screws 330 used in securing the electrical cable in place. In other implementations, the cable may be secured using a single set screw, or by crimping or soldering. The contact 130 is made from a conductive material such as copper, copper alloys, or brass. Other conductive materials may be used.

A drive pin 335 extends from the body position 305. As discussed below, and as shown in FIGS. 4G–4J the drive pin fits within the groove 220 of the retention ring 200 and is used in securing the contact 130 in the insulating sleeve 105.

The connection portion 310 has a smaller diameter than the body portion 305. The connection portion 310 includes a gap 340 that extends from an end 345 of the connection portion 310 to a hole 350 in the body portion 305. The gap 340 allows for thermal expansion of the connection portion 310.

The end 345 of the connection portion 310 is circular with a flattened section 355. The flattened section 355 extends a short distance along the length of the connection portion 310 until it terminates in a circumferential groove 360 that extends partially around the circumference of the connection portion 310. In use, the flattened section 355 permits insertion of the end 345 into a similarly-shaped opening in a mating contact. The contacts are then rotated relative to each other until the lip 365 is between the circumferential groove 360 and the end 345 locks with the corresponding circumferential groove in the mating contact. Thereafter, a front wall 370 of the groove 360 prevents axial movement of the contacts relative to each other.

Figure 4A:
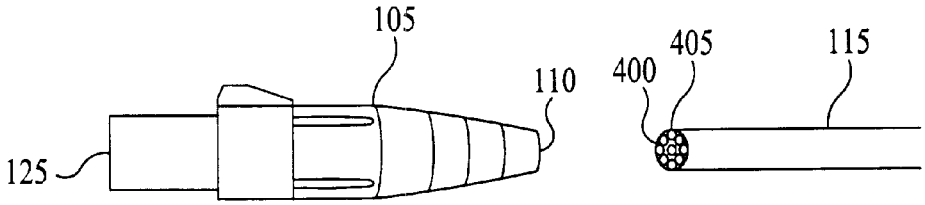
FIGS. 4A–4D are sequential views showing assembly of the connector.
Figure 4B:
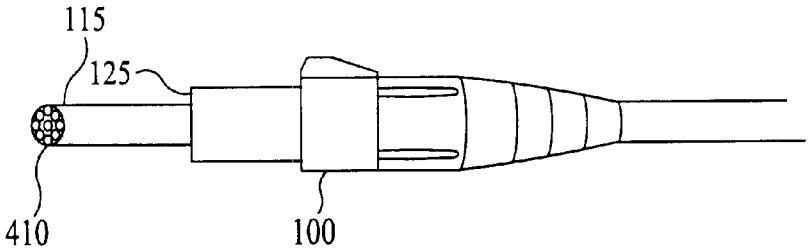

Assembly of the contact 100 is illustrated in FIGS. 4A–4J. Referring to FIG. 4A, the electrical cable 115 is inserted into the tapered end 110 of the insulating sleeve 105 until the cable 115 extends from the end 125, as shown in FIG. 4B. As shown in FIG. 4A, the cable 115 includes multiple conductive elements 400 surrounded by an insulating sleeve 405.

Figure 4C:
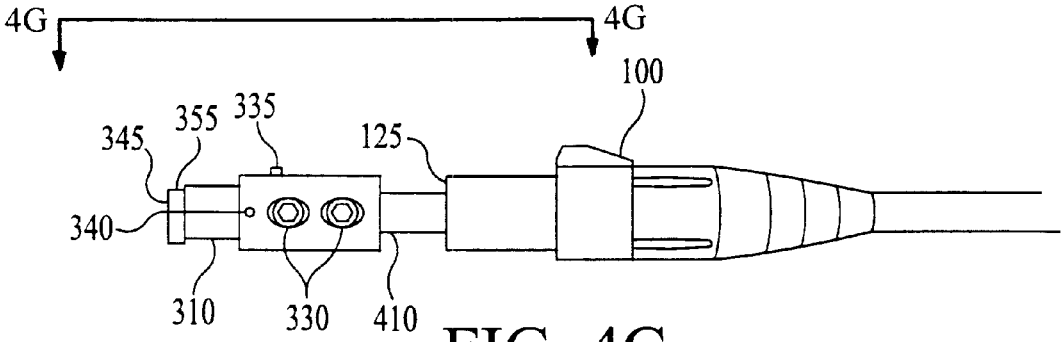
Figure 4D:
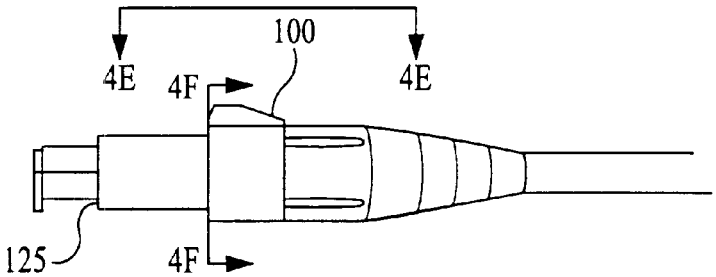
Figure 4E:
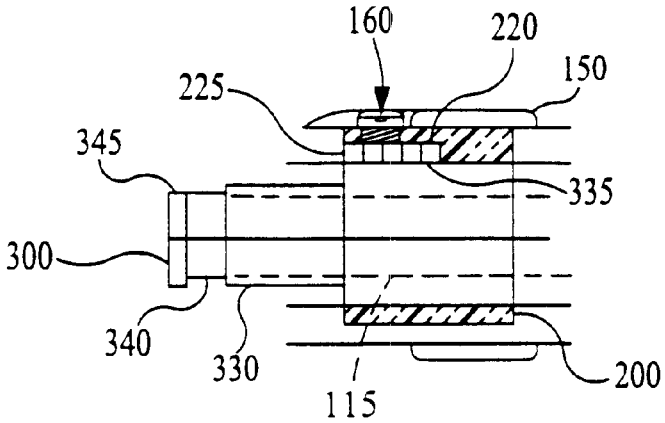
FIG. 4E is a sectional view taken along line 4E—4E of FIG. 4D.
Figure 4F:
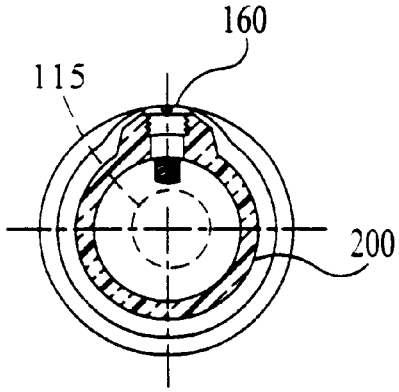
FIG. 4F is a sectional view taken along line 4F—4F of FIG. 4D.
Figure 4G:
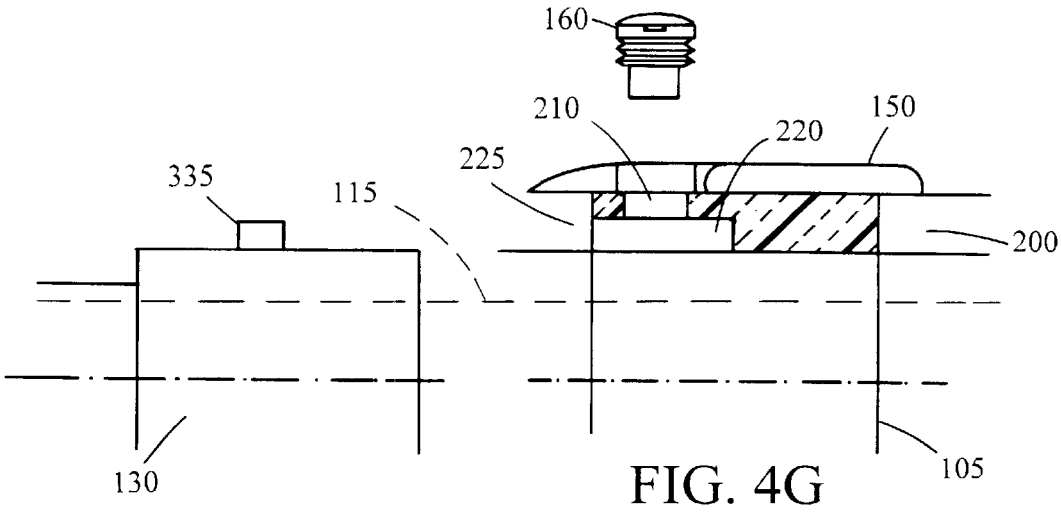
FIGS. 4G–4J are sequential, upper-half sectional views showing assembly of the connector.
Figure 4H:
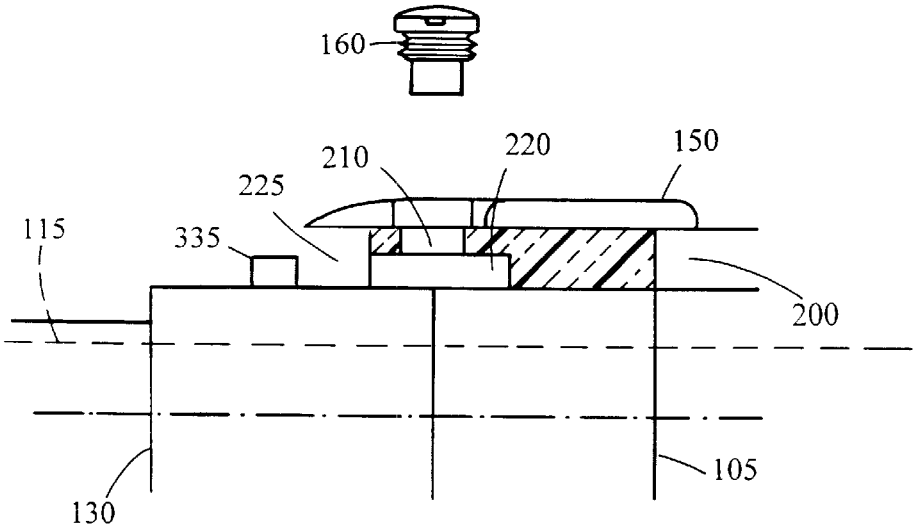
Figure 4I:
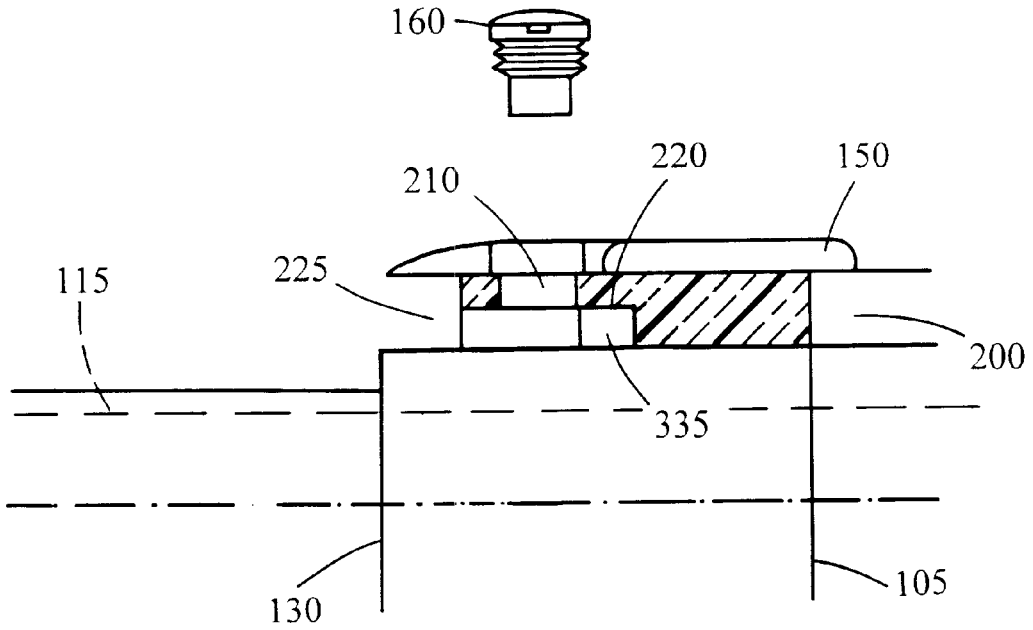
Figure 4J:
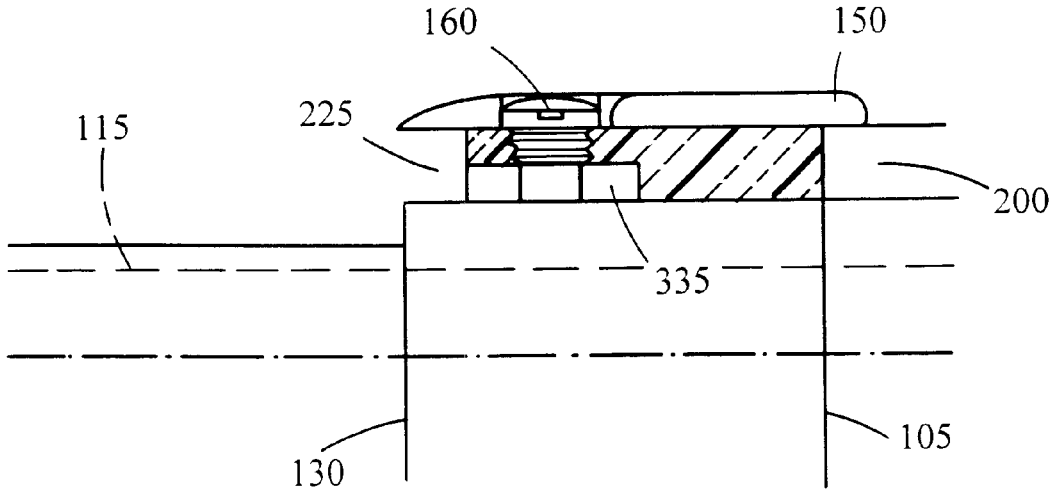

Referring to FIG. 4C, insulation is stripped from the end 410 of the electrical cable 115, and the conductive elements 400 at the end 410 are placed in the channel 315 of the contact 130. The two cable retaining plugs 330 then are tightened to secure the electrical cable 115 to the contact 130. Once the contact 130 is attached to the end 410 of the electrical cable 115, the electrical cable 115 is pulled back into the insulating sleeve 105. The contact 130 is positioned so that the drive pin 335 fits within the groove 220 of the retention ring 200 as shown in FIGS. 4G and 4H. The contact 130 is pushed into the sleeve 105 until the drive pin 335 abuts the rear of the groove 220, as shown in FIGS. 4D, 4I and 4J. The screw 160 then is turned until the screw 160 extends into the groove 220 and blocks movement of the drive pin 335 to lock the contact 130 in place. As shown in FIGS. 4E, 4F and 4J, screw 160 blocks the open end of the groove 220, which prevents the drive pin 335 from being pulled out of the groove 220 and thereby prevents the contact 130 from being pulled out of the sleeve 105. The screw hole 155 is positioned relative to the end of the groove 220 so that little, if any, axial motion of the contact 130 relative to the sleeve 105 is permitted once the groove 220 is blocked. Similarly, the groove 220 is sized relative to the drive pin 335 so that little, if any, rotational motion of the contact 130 is permitted.

Figure 5A:
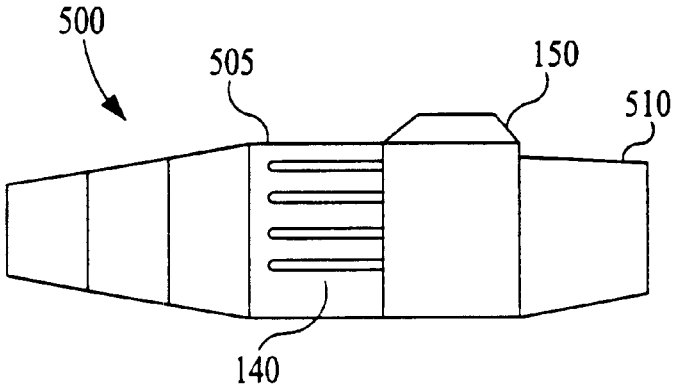
FIGS. 5A and 5B are side and end views of a connector for use with the connector of FIG. 1A.
Figure 5B:
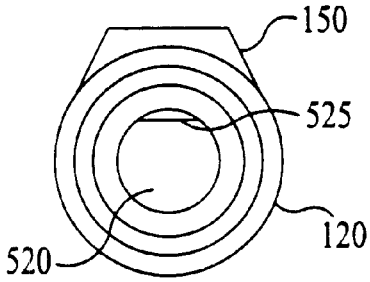

Referring to FIGS. 5A and 5B a female connector 500 for use with the connector 100 includes an insulating sleeve 505 that is similar in shape and operation to the insulating sleeve 105 of the connector 100. The sleeve 505 differs only in that it includes a connection portion 510 that is of smaller diameter than the connection portion 120 of the sleeve 105, and is sized to be received within the connection portion 120. The connector 500 includes a retention ring (not shown) that operates in the same manner as the retention ring 200.

Figure 5C:
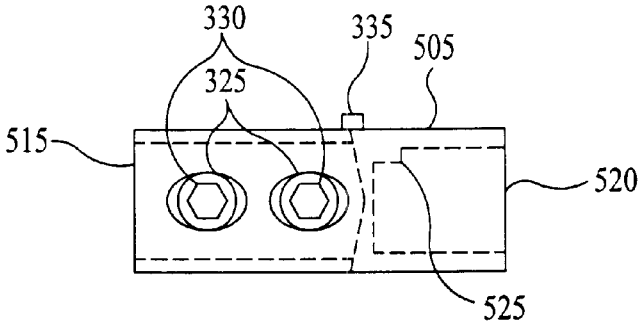
FIGS. 5C and 5D side and end views of a contact of the connector of FIG. 5A.
Figure 5D:
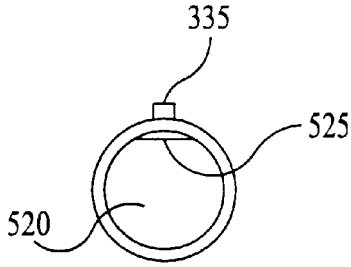

Referring to FIGS. 5C and 5D, a contact 515 of the connector 500 is configured similarly to the contact 130 of the connector 100. The contacts differ in that the contact 515 includes a connection channel 520 instead of a connection portion 310. The channel 520 is sized to receive the connection portion 310. The channel 520 is circular and includes a flattened section 525 that conforms to the flattened section 355 of the contact 130. The flattened section 525 extends only a short way along the length of the channel and serves to retain the connection portion 310 in the channel 520, as discussed above. Friction between the connection portions of the insulating sleeves inhibits relative rotation of the connectors.

Other embodiments are within the scope of the following claims.

What is claimed is:

1. A single-pole electrical connector comprising:

an insulating sleeve defining an inner channel;

a groove defined in a surface of the inner channel;

an electrical contact positioned within the inner channel and including a drive pin extending from an outer surface of the contact and sized to fit within the groove; and a blocking mechanism operable to be positioned in the groove to block the groove and to secure the electrical contact in the insulating sleeve.

2. The connector of claim 1, wherein the channel and contact have circular cross sections.

3. The connector of claim 1, further comprising a retention ring positioned in the insulating sleeve and defining at least a portion of the inner channel.

4. The connector of claim 3, wherein the groove is defined in an inner surface of the retention ring.

5. The connector of claim 4, wherein the retention ring carries the blocking mechanism.

6. The connector of claim 5, wherein the blocking mechanism comprises a screw and the retention ring comprises a threaded hole configured to receive the screw.

7. The connector of claim 6, wherein the screw comprises a nonconductive screw having a nonconductive head and a nonconductive threaded portion.

8. The connector of claim 7, wherein the screw is accessible from outside the insulating sleeve through a hole in the insulating sleeve.

9. The connector of claim 8, wherein a cross section of at least a portion of the hole is smaller than a maximum cross section of the screw to prevent separation of the screw from the electrical connector.

10. The connector of claim 6, wherein the threaded hole intersects the groove.

11. The connector of claim 10, wherein the threaded hole is perpendicular to the groove.

12. The connector of claim 1, wherein the blocking mechanism comprises a screw.

13. The connector of claim 12, wherein the screw may be positioned in an extended position in which the screw intersects the channel to block the channel or a retracted position in which the screw is retracted from the channel and does not block the channel.

14. The connector of claim 12, wherein the screw comprises a nonconductive screw having a nonconductive head and a nonconductive threaded portion.

15. The connector of claim 12, wherein the screw is accessible from outside the insulating sleeve through a hole in the insulating sleeve.

16. The connector of claim 15, wherein a cross section of at least a portion of the hole is smaller than a maximum cross section of the screw to prevent separation of the screw from the electrical connector.

17. A single-pole electrical connector comprising:

an insulating sleeve;

a retention ring positioned in the insulating sleeve and defining an inner channel, a groove in a surface of the inner channel, and a threaded hole intersecting the groove;

a screw positioned in the threaded hole so as to block the groove when in an extended position and to leave the groove unblocked when in a retracted position; and a contact positioned in the inner channel, the contact including a drive pin positioned in the groove;

wherein the contact is secured within the insulating sleeve when the screw is in the extended position and movable relative to the insulating sleeve when the screw is in the retracted position.

18. A method of securing an electrical contact having a drive pin extending from an outer surface of the contact in an insulating sleeve of an electrical connector, the insulating sleeve defining an inner channel having a groove in a surface of the inner channel, the method comprising:

inserting the electrical contact into the inner channel with the drive pin in the groove, the drive pin sized to fit within the groove; and blocking the groove to secure the electrical contact in the insulating sleeve.

* * * * *